US006517313B2

(12) United States Patent
Rogers

(10) Patent No.: US 6,517,313 B2
(45) Date of Patent: Feb. 11, 2003

(54) SEGMENTED TURBINE VANE SUPPORT STRUCTURE

(75) Inventor: Mark John Rogers, Kennebunk, ME (US)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 09/887,011

(22) Filed: Jun. 25, 2001

(65) Prior Publication Data

US 2002/0197153 A1 Dec. 26, 2002

(51) Int. Cl.[7] ..... F01D 9/04

(52) U.S. Cl. ..... 415/137; 415/138; 415/209.3; 415/209.4; 415/209.2

(58) Field of Search ..... 415/136, 137, 415/138, 139, 189, 190, 209.2, 209.3, 209.4; 29/889.22

(56) References Cited

U.S. PATENT DOCUMENTS

| | | | | |
|---|---|---|---|---|
| 2,605,997 A | * | 8/1952 | Lombard et al. | 415/137 |
| 3,067,983 A | | 12/1962 | Koziura | |
| 3,075,744 A | | 1/1963 | Peterson | |
| 3,423,071 A | | 1/1969 | Noren | |
| 3,841,787 A | | 10/1974 | Scalzo | |
| 4,511,306 A | | 4/1985 | Hultgren | |
| 4,639,189 A | | 1/1987 | Rosman | |
| 5,118,120 A | * | 6/1992 | Drerup et al. | 415/139 |
| 5,961,278 A | | 10/1999 | Dorais et al. | |

FOREIGN PATENT DOCUMENTS

| | | |
|---|---|---|
| GB | 0486340 | 6/1938 |

* cited by examiner

*Primary Examiner*—Christopher Verdier

(57) ABSTRACT

A segmented vane support structure for use in a gas turbine engine having an engine casing, includes a single piece inner ring and separated front outer and rear outer rings. The vane segments circumferentially abut to form a stator ring which is clamped at the respective opposed outer ends by the front outer and rear outer rings therebetween onto the inner ring. The front outer and rear outer rings are axially restrained to the engine casing by a retaining ring which is fitted in an inner annular groove of the engine casing. Each vane segment has a lug member at its outer diameter which radially and slidably engages in a slot of the engine casing to provide angular positioning of the vane segments within the engine casing and to transmit circumferential vane load into the engine casing. This support structure arrangement transmits circumferential loading to the engine casing and isolates radial loading from the engine casing caused by thermal growth changes of the vane segments.

14 Claims, 2 Drawing Sheets

SEGMENTED TURBINE VANE SUPPORT STRUCTURE

FIELD OF THE INVENTION

The invention is directed toward a support structure for stator vane segments used in a gas turbine engine. The invention is also directed toward an improved stator assembly in a gas turbine engine, which assembly incorporates the support structure.

BACKGROUND OF THE INVENTION

Second stator assemblies in gas turbine engines usually have the inner radial end of the assembly floating on a seal arrangement on the rotating shaft of the turbine. The outer radial end of the assembly must be fixed to the outer engine casing. This is usually done by a ring-like support structure. However, in fixing the outer end of the second stator assembly to the outer engine casing, thermal expansion of the stator vane segments can cause distortion of the support structure which, in turn, can cause distortion in the outer engine casing. Distortion of the outer engine casing can change blade tip clearances for the blades in adjacent rotor assemblies in the engine which can reduce the efficiency of the engine.

The distortion could be reduced by adequate cooling of the stator vane segments. However, it is difficult to efficiently cool the vane segments when they are fixedly mounted at their outer ends.

Efforts have been made to develop segmented vane support structures which permit thermal expansion of the stator vane segments without causing distortion in the outer engine casing. An example of those efforts is shown in U.S. Pat. No. 5,961,278, issued to Dorais, et al. on Oct. 5, 1999, which is assigned to the assignee of this application. Dorais, et al. describe a cylindrical support structure for use in stator assembly gas turbine engines having an engine casing. The support structure has two outer ring sections between which vane segments of the stator assembly will be mounted and a central ring section by means of which the support structure will be radially located within the engine casing. The rings are joined to form the cylindrical shaped structure by thin, circumferentially spaced-apart spokes extending between each outer ring and the central ring. The spokes are thin enough to flex or distort when the stator vane segments thermally expand, expanding or distorting the outer mounting rings. Thus, the flexible spokes attenuate the distortion transmitted from the outer mounting rings to the central ring and further to the engine casing. The inner ends of the vane segments are mounted between inner engine housings which clamp the vane segments by bolts and nuts to locate them axially and radially.

SUMMARY OF THE INVENTION

It is an object of the present invention to provide a support structure for use in a gas turbine engine to mount the outer end of the stator assembly to the engine casing, which support structure permits thermal expansion of the stator vane segments without causing distortion of the engine casing.

It is another object of the present invention to provide a stator assembly which permits thermal expansion of the stator vane segments without causing distortion of the engine casing, and is easily assembled.

In accordance with one aspect of the present invention, there is a support structure provided for supporting vane segments of a stator assembly in a gas turbine engine having an engine casing. The vane segments circumferentially abut to form a stator ring. The support structure comprises means for transmitting a circumferential vane load from each vane segment into the engine casing. The means are disposed between each vane segment and the engine casing. The support structure further includes separated front outer and rear outer rings, which, in cooperation with the engine casing, axially restrain the vane segments between the front outer and rear outer rings, thereby defining an axial position of the vane segments with respect to the engine casing while permitting radial thermal expansion of the vane segments without causing distortion of the engine casing.

In accordance with another aspect of the present invention, there is a method provided for supporting vane segments of a stator assembly in a gas turbine engine and inhibiting transmission of thermal distortion from the vane segments into the engine casing. The method comprises transmitting a circumferential vane load into the engine casing by providing a lug member secured to each vane segment, the lug member being radially slidable in a slot of the engine casing; and defining an axial position of the vane segments within the engine casing using front outer and rear outer rings which are axially separated by the vane segments, the front outer ring being axially restrained by a first annular radial surface of the engine casing and the rear outer ring being axially restrained by a second annular radial surface of the engine casing such that the front outer and the rear outer rings are radially displaceable relative to the engine casing.

It is preferable that the front outer and the rear outer rings axially abut outer edges of the outer platform of each vane segment at opposed ends thereof, respectively. The method preferably further comprises using a retaining ring which is fitted in an inner annular groove of the engine casing, to abut a rear end of the rear outer ring and further to cause a front end of the front outer ring to abut the first annular radial surface of the engine casing.

In accordance with a further aspect of the present invention, there is provided a stator assembly in a gas turbine engine having an engine casing. The stator assembly comprises an inner support ring and a plurality of vane segments circumferentially around the inner support ring and abutting one another to form a stator ring. In cooperation with the engine casing, separated front outer and rear outer rings axially restrain the stator ring with respect to the engine casing, while permitting radial thermal expansion of vane segments without causing distortion of the engine casing. Means are provided for transmitting a circumferential vane load from each vane segment into the engine casing. The means are disposed between each vane segment and the engine casing.

The advantage of the present invention lies in the outer support structure which is constructed from two small rings, one at the front and one at the rear, which clamp the vane segments onto a single piece inner ring and the vane segments themselves have lug members for positioning the assembly and reacting the torque loading. In this arrangement, the angular positioning of each vane segment within the engine casing is controlled by one set of lug members and slot interfaces only and the circumferential vane loading from each individual segment is transmitted by its own lug member into the engine casing, which provides an even loading of the lug members in the structure. With the separated outer rings, it is possible to assemble the vane segments onto the single piece inner support ring that requires no bolted features, rivets, welds or mating parts to retain the segments, since the segments are retained by the two outer rings which are axially restrained within the engine casing by a retaining ring.

Other advantages and features of the present invention will be better understood with reference to a preferred embodiment of the present invention described hereinafter.

BRIEF DESCRIPTION OF THE DRAWINGS

Having thus generally described the nature of the invention, reference will now be made to the accompanying drawings, shown by way of illustration, of preferred embodiments thereof, and in which.

DETAILED DESCRIPTION OF THE PREFERRED EMBODIMENT

Figure 1:
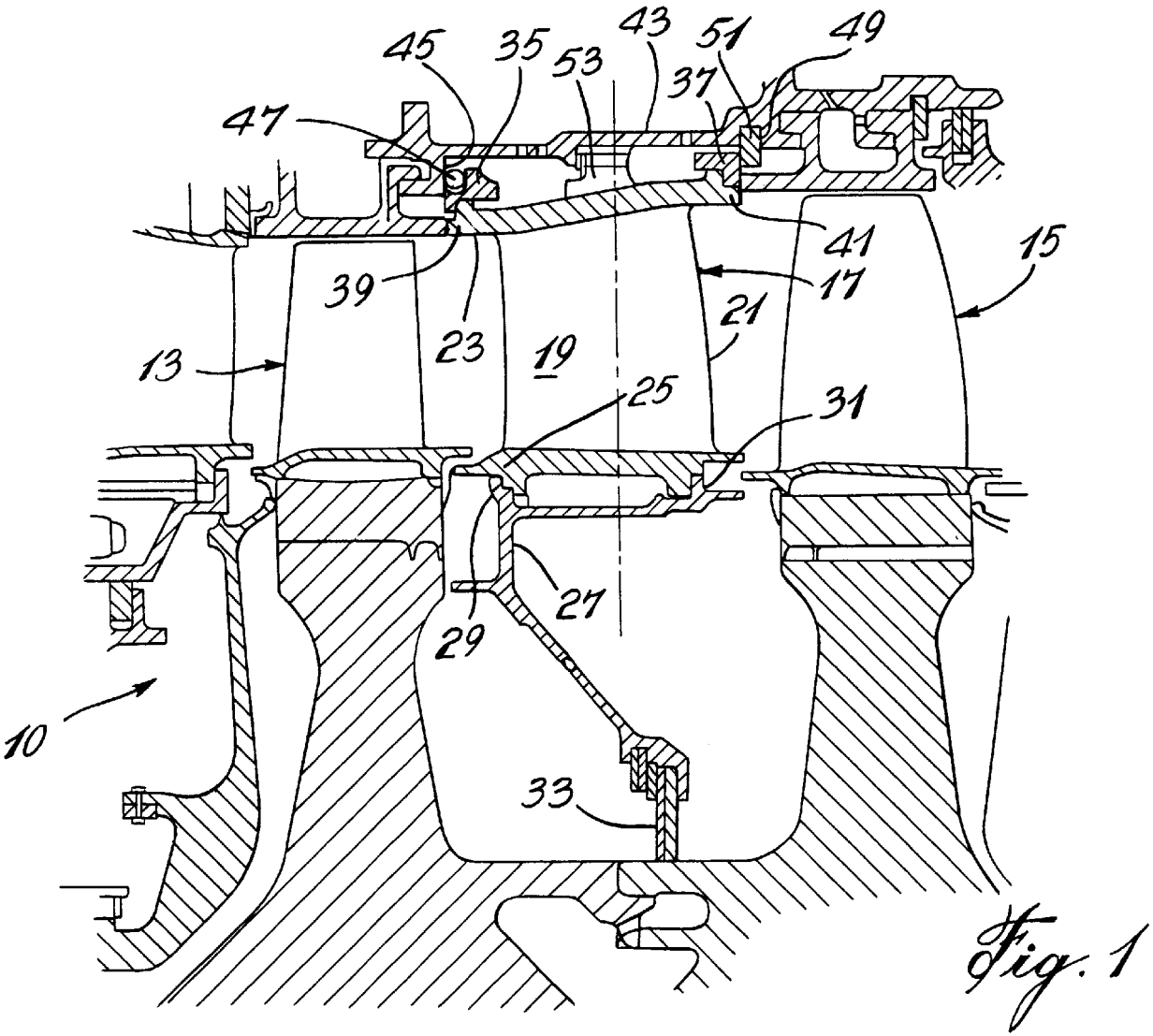
FIG. 1 is a partial cross-sectional view through the stator of a gas turbine engine, incorporated with a preferred embodiment of the present invention.
Figure 2:
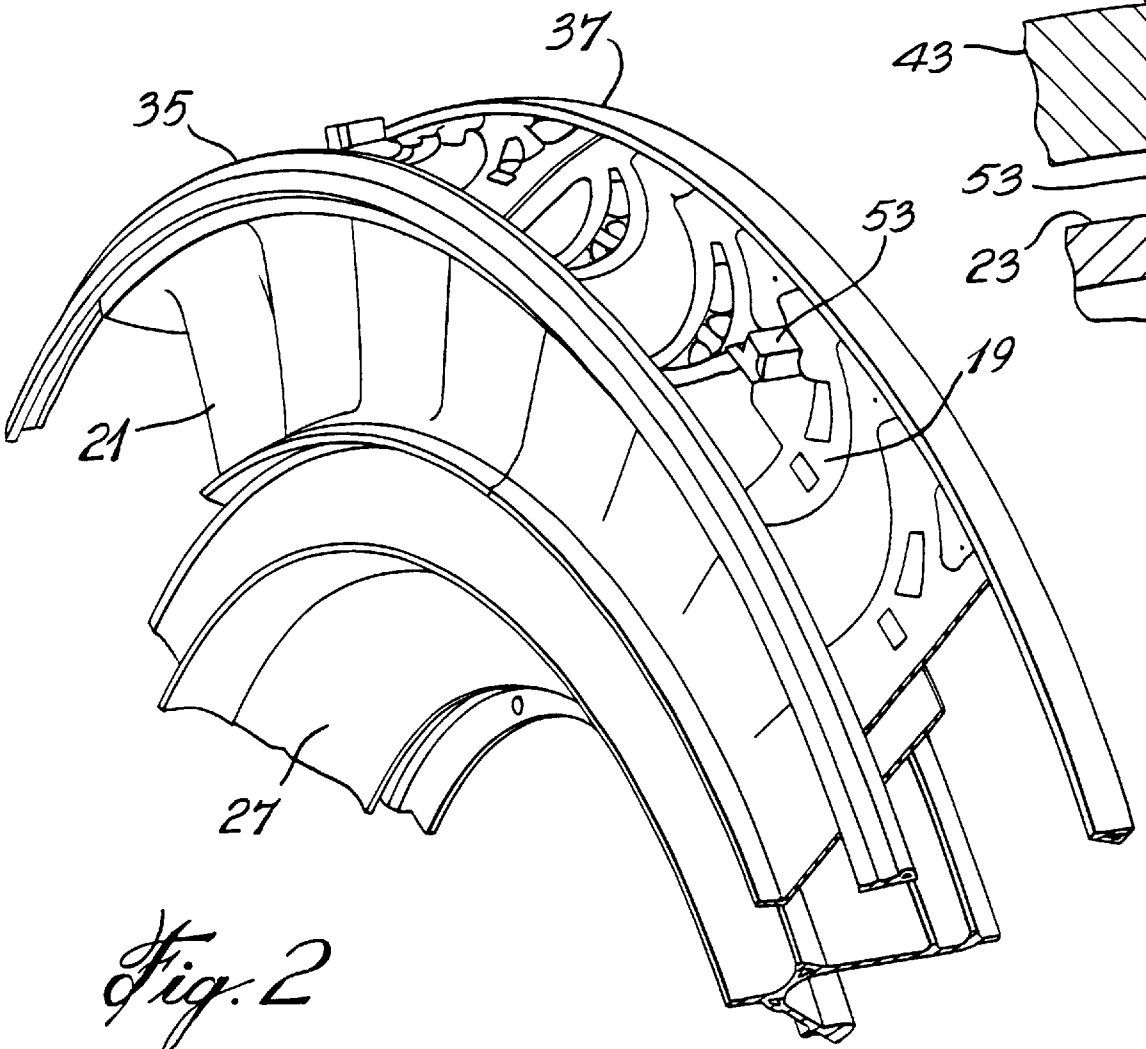
FIG. 2 is a partial perspective view of the embodiment of FIG. 1, showing the vane segments assembled into a single piece inner support ring and supported by two outer support rings.

Referring to the drawings, particularly FIG. 1, a gas turbine engine 10 has axially spaced-apart rotor stages 13, 15, between which is mounted a stator stage 17. The stator stage 17 includes a plurality of stator vane segments 19 that are mounted in circumferentially abutting relationship to form a circular ring, as illustrated in FIG. 2, which shows two vane segments only. Each vane segment 19 has more than one vane 21 extending between the outer vane platform 23 and the inner vane platform 25. The side edges of the outer vane platforms 23 abut as do the side edges of the inner vane platforms 25 when forming the stator ring. The inner vane platforms 25 are mounted around an inner support ring 27 between two radially extending flanges 29, 31 thereof. The inner support ring has the inner radial end floating. on a seal arrangement 33 on the rotating shaft of the turbine and radially locates the vane segments 19 with respect to the rotating shaft of the turbine. Separated front outer and rear outer rings 35, 37 are provided, as shown in FIGS. 1 and 2, between which the stator ring formed by the vane segments 19 is mounted. The front outer and rear outer rings 35, 37 are fitted over outer edges 39, 41 of the outer platforms 23 of the vane segments 19 at opposed ends thereof, respectively, and axially abut radial flanges of the respective outer edges 39, 41 to clamp the vane segments 19 onto the single piece inner support ring 27.

In cooperation with the engine casing 43 as shown in FIG. 1, the front outer and rear outer rings 35, 37 define the axial position of the vane segments 19 within the engine casing 43.

The front end of the front outer ring 35 abuts the first annular radial surface 45 of the engine casing 43 such that the front outer ring 35 is axially restrained by the annular first surface 45. Preferably, a seal ring 47 is provided between the first annular radial surface 45 and the front outer ring 35 to inhibit hot gas leakage. The front outer ring 35 is radially spaced a small annular gap apart from the cylindrical wall of the engine casing 43 and, therefore, the front outer ring 35 is radially displaceable relative to the engine casing 43. Thus, distortion of the front outer ring 35 caused by radial thermal expansion of the vane segments 19 will not be transmitted into the engine casing 43.

The rear outer ring 37 is axially restrained by a second annular radial surface 49 of the engine casing 43. In this particular embodiment, this is achieved by a retaining ring 51 which is fitted in an annular groove of the engine casing 43. The second radial surface 49 forms a rear side wall of the annular groove. The retaining ring 51 abuts the rear end of the rear outer ring 37 and causes the front end of the front outer ring 35 to abut the first annular radial surface 45 of the engine casing 43. Similar to the front outer ring 35, the rear outer ring 37 is radially spaced a small annular gap apart from the cylindrical wall of the engine casing 43 and, therefore, is displaceable radially relative thereto, in order to permit distortion of the rear outer ring 37 caused by the thermal radial expansion of the vane segments 19 without causing distortion of engine casing 43.

Figure 3:
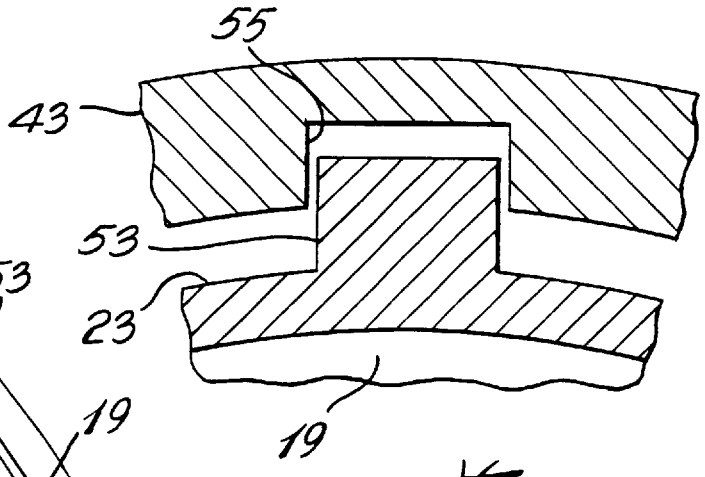
FIG. 3 is a partial and detailed cross-sectional view of the stator assembly of FIG. 1, showing the means for transmitting a circumferential vane load into the engine casing.

Means for transmitting circumferential vane load from each vane segment 19 into the engine casing 43 are provided between each vane segment 19 and the engine casing 43. In this particular embodiment, the circumferential vane load transmitting means includes a lug member 53 secured to the vane segment 19, extending radially and outwardly from the outer vane platform 23 of the vane segment 19. The lug member 53 is radially slidable in a slot 55 in the engine casing 43, and is circumferentially restrained by interfaces of the lug member 53 and slot 55, as shown in FIG. 3. Thus, the lug members 53 angularly position the whole stator ring of the vane segments 19 by interfaces of the lug member 53 and the slot 55. The circumferential vane loading from each individual vane segment 19 is therefore transmitted by its own lug member 53 into the engine casing 43, which provides an even loading of the lug members 53 in this structure. The lug member 53 is permitted to radially slide within a small range in the slot 55 when distortion of the outer vane platform 23 is caused by thermal expansion of the vane segments 19. Thus, the lug member and slot arrangement allows the vane segments 19 to grow radially relative to the engine casing 43 without transmitting radial load into the engine casing 43.

The entire assembly of the vane segments with the support outer and inner rings is inserted in the engine casing and the retainer ring 51 is fitted into the annular groove 49, to prevent disengagement of the outer rings 37. The assembly process does not require bolts and nuts, rivets, welds and the like, thereby reducing labour required during the assembly process.

Modifications and improvements to the above-described embodiments of the invention may become apparent to those skilled in the art. The foregoing description is intended to be exemplary rather than limiting. The scope of the invention is therefore intended to be limited solely by the scope of the appended claims.

I claim:

1. A support structure for supporting vane segments of a stator assembly in a gas turbine engine having an engine casing, the vane segments circumferentially abutting to form a stator ring, the support structure comprising:

means for transmitting circumferential vane load from each vane segment into the engine casing, the means being disposed between each vane segment and the engine casing; and separated front outer and rear outer rings, in cooperation with the engine casing, axially restraining the vane segments between the front outer and rear outer rings, thereby defining an axial position of the vane segments with respect to the engine casing while permitting radial thermal expansion of vane segments without causing distortion of the engine casing.

2. A support structure as claimed in claim 1 wherein the circumferential vane load transmitting means comprises a lug member secured to each of the vane segments and adapted to be radially slidable in a slot in the engine casing.

3. A support structure as claimed in claim 2 wherein the front outer and rear outer rings axially abut outer edges of an outer platform of each vane segment at opposed ends thereof, respectively.

4. A support structure as claimed in claim 3 wherein the lug member extends radially and outwardly from the outer platform of the vane segment.

5. A support structure as claimed in claim 1 further comprising a retaining ring adapted to be fitted in an inner annular groove of the engine casing, the retaining ring abutting a rear end of the rear outer ring and thereby causing a front end of the front outer ring to abut an annular radial surface of the engine casing.

6. A method for supporting vane segments of a stator assembly in a gas turbine engine and inhibiting transmission of thermal distortion from the vane segments into an engine casing, comprising:

transmitting circumferential vane load into the engine casing by providing a lug member secured to each vane segment, the lug member being radially slidable in a slot of the engine casing; and defining an axial position of the vane segments within the engine casing using front outer and rear outer rings which are axially separated by the vane segments, the front outer ring being axially restrained by a first annular radial surface of the engine casing and the rear outer ring being axially restrained by a second annular radial surface of the engine casing such that the front outer and rear outer rings are radially displaceable relative to the engine casing.

7. A method as claimed in claim 6 wherein the front outer and rear outer rings axially abut outer edges of an outer platform of each vane segment at opposed ends thereof, respectively.

8. A method as claimed in claim 7 further comprising using a retaining ring which is fitted in an inner annular groove of the engine casing, to abut a rear end of the rear outer ring and further to cause a front end of the front outer ring to abut the first annular radial surface of the engine casing.

9. A method as claimed in claim 7 wherein the front outer and rear outer rings are fitted over outer edges of the outer platforms of the vane segments at opposed ends respectively.

10. A stator assembly in a gas turbine engine having an engine casing, the stator assembly comprising:

an inner support ring, a plurality of vane segments circumferentially around the inner support ring and abutting one another to form a stator ring;

separated front outer and rear outer rings, in cooperation with the engine casing, axially restraining the stator ring with respect to the engine casing while permitting radial thermal expansion of vane segments without causing distortion of the engine casing; and means for transmitting circumferential vane load from each vane segment into the engine casing, the means being disposed between each vane segment and the engine casing.

11. A stator assembly as claimed in claim 10 wherein the circumferential vane load transmitting means comprises a lug member secured to the vane segment, the lug member being radially slidable in a slot in the engine casing.

12. A stator assembly as claimed in claim 11 wherein the lug member extends radially and outwardly from an outer platform of the vane segment.

13. A stator assembly as claimed in claim 10 wherein the front and rear outer rings axially abut outer edges of an outer platform of each vane segment at opposed ends thereof, respectively.

14. A stator assembly as claimed in claim 10 further comprising a retaining ring fitted in an inner annular groove of the engine casing, the retaining ring abutting a rear end of the rear outer ring and thereby causing a front end of the front outer ring to abut an annular radial surface of the engine casing.

* * * * *